US008465608B1

(12) United States Patent
Coffey et al.

(10) Patent No.: US 8,465,608 B1
(45) Date of Patent: Jun. 18, 2013

(54) METHODS FOR FORMING IGNITABLE HETEROGENEOUS STRUCTURES

(71) Applicants: Kevin R. Coffey, Oviedo, FL (US); Edward Alan Dein, Saint Cloud, FL (US); Bo Yao, Orlando, FL (US)

(72) Inventors: Kevin R. Coffey, Oviedo, FL (US); Edward Alan Dein, Saint Cloud, FL (US); Bo Yao, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 0 days.

(21) Appl. No.: 13/630,637

(22) Filed: Sep. 28, 2012

Related U.S. Application Data

(62) Division of application No. 12/398,228, filed on Mar. 5, 2009, now Pat. No. 8,298,358.

(60) Provisional application No. 61/034,825, filed on Mar. 7, 2008.

(51) Int. Cl.
*D03D 43/00* (2006.01)

(52) U.S. Cl.
USPC ..... 149/109.6; 149/2; 149/14; 149/15; 149/37; 149/108.2; 149/109.2

(58) Field of Classification Search
USPC ..... 149/2, 14, 15, 37, 108.2, 109.2, 109.6
See application file for complete search history.

(56) References Cited

U.S. PATENT DOCUMENTS 6,666,936 B1 * 12/2003 Jorgensen et al. ..... 149/37
6,792,867 B1 * 9/2004 Jorgensen et al. ..... 102/335
2004/0060625 A1 * 4/2004 Barbee et al. ..... 149/15
2005/0081969 A1 * 4/2005 Mei et al. ..... 149/41
2007/0095445 A1 * 5/2007 Gangopadhyay et al. ..... 149/37

OTHER PUBLICATIONS

Coffey, K.R. and Kumar, R., "Thin Film Energetic Materials," presented at the 2nd Eglin Symposium on Nano-Energetics (ESNE2), Shalimar, Florida, Mar. 22-23, 2006.

T. N. Taylor, et al., "Reaction of Vapor-Deposited Aluminum with Copper Oxide", J. Vac. Sci. Technol. A 9(3), May/Jun. 1991, pp. 1840-1846, American Vacuum Society.

Timothy Campbell, et al., "Dynamics of Oxidation of Aluminum Nanoclusters using Variable Charge Molecular-Dynamics Simulations on Parallel Computers", Physical Review Letters, vol. 82, No. 24, Jun. 14, 1999, pp. 4868-4869.

K. J. Blobaum, et al., "Deposition and Characterization of a Self-Propagating CuOx/Al Thermite Reaction in a Multilayer Foil Geometry", Journal of Applied Science, vol. 94, No. 5, Sep. 1, 2003, pp. 2915-2922.

(Continued)

*Primary Examiner* — James McDonough
(74) *Attorney, Agent, or Firm* — Jetter & Associates, P.A.

(57) ABSTRACT

A method for forming a metastable intermolecular composite (MIC) includes providing a vacuum level of $<10^{-8}$ torr base pressure in a deposition chamber. A first layer of a first material of a metal that is reactive with water vapor is deposited, followed by depositing a second layer of a second material of a metal oxide on the first layer. The first and second material are capable of an exothermic chemical reaction to form at least one product, and the first and second layer are in sufficiently close physical proximity so that upon initiation of the exothermic reaction the reaction develops into a self initiating chemical reaction. An interfacial region averaging <1 nm thick is formed between the first layer and second layer from a reaction of the first material with water vapor. In one embodiment, the first material is Al and the second material is CuOx.

10 Claims, 3 Drawing Sheets

OTHER PUBLICATIONS

Christopher E. Aumann, et al., "Metastable Interstitial Composites: Super Thermite Powders", Insensitive Munitions Technology Symposium, Jun. 6-9, 1994, Williamsburg, VA.

Fuyuki Shimojo, et al., "Electronic processes in fast thermite chemical reactions: A first-principles molecular dynamics study", The American Physical Society, Physical Review E 77, pp. 086103-1 to 086103-7 (2008).

K. J. Blobaum, et al., "Investigating the reaction path and growth kinetics in CuOx/Al multilayer foils", Journal of Applied Physics, vol. 94, No. 5, pp. 2923-2929, Sep. 1, 2003.

* cited by examiner

METHODS FOR FORMING IGNITABLE HETEROGENEOUS STRUCTURES

CROSS REFERENCE TO RELATED APPLICATIONS

This application is a divisional application of U.S. non-provisional patent application Ser. No. 12/398,228 entitled "IGNITABLE HETEROGENEOUS STRUCTURES AND METHODS FOR FORMING", filed Mar. 5, 2009, now U.S. Pat. No. 8,298,358, which claims priority to Provisional Application Ser. No. 61/034,825 entitled "IGNITABLE HETEROGENEOUS STRUCTURES AND METHODS FOR FORMING", filed on Mar. 7, 2008, both of which are incorporated herein by reference in their entirety into this application.

FEDERAL RIGHTS

The U.S. Government may have certain rights to the invention based on Contract No. FA95500710349 with the Air Force Office of Scientific Research (AFOSR).

FIELD OF THE INVENTION

Embodiments of the invention relate to composite material structures that can sustain the self-propagating reactions and related ignitable structures.

BACKGROUND

A composite structure that can sustain a self-propagating reaction is commonly referred to as a metastable intermolecular composite (MIC) material. MICs generally comprise two compositionally different solid materials in intimate contact. These two materials are selected such that upon initiation they are capable of a chemical reaction with one another to form a different material or materials (products), and release heat. An example of a MIC comprising a pair of materials is copper oxide ($CuO_x$; e.g. CuO) and Al, which upon reaction form product materials Cu and $Al_2O_3$. The heat released from such a reaction warms the adjacent unreacted composite structure and promotes the rapid reaction of the adjacent regions. Thus, once initiated in one region of the composite structure, the reaction may be sustained and propagate throughout the composite structure. This is often called a "self-propagating" reaction. A MIC is an example of what is referred to as an "energetic" material.

Energetic materials based upon organic (primarily C, H, N, and O) chemistries are used as propellants and explosives by the U.S. military in a large range of weapon systems. Inorganic chemistries, such as used in conventional MIC's, offer similar energy per unit weight of reactants, but can also offer a significant advantage of higher energy per unit volume of reactants (energy density).

Energy density is one of two major performance considerations for applications of energetic materials, the other being the material's reaction velocity, which is also known as the burn rate. Other important considerations for energetic materials include storage lifetime and sensitivity to unwanted (e.g. inadvertent) initiation of the reaction. The product of the energy density and burn rate provides the volumetric reactive power, which is also considered as a performance metric.

The maximum energy density that may be obtained from combustion of MIC's generally depend strongly on the physical form of the composite material. MIC materials prepared from particulates can have densities much less than the theoretical maximum density (TMD) of the materials in their bulk forms. Loose powders typically have densities that are only 5% to 10% of the TMD, and thus negate the energy density advantage of the inorganic energetic materials. Compacted MIC powders generally achieve densities of 60% to 80% of their TMD, and can partially recover the energy density benefits. Layered nano-composite MIC materials are typically fully dense and generally preserve the energy density advantage of the inorganic energetic material.

The burn rate (or reaction velocity) is the second major performance consideration for military and some other applications of energetic materials, and it is significantly enhanced by the use of nanoscale physical forms for the inorganic reactant materials. However, maximum burn rates of conventional organic energetic materials are generally much higher (up to 9,000 m/s) than those of inorganic energetic materials (typically less than 1,000 m/s).

For MIC's using particulate materials, the energy density and burn rate are often inversely related. While burn rates as high as 1,000 m/s have been reported for loose powders (typical densities 5% to 10% of the TMD), burn rates for consolidated powders tend to be significantly lower. The qualitative difference between these two cases can be attributed to the forward convection of hot gases in low density powder assemblies, which is restricted or essentially eliminated in higher density materials.

Physical vapor deposition techniques (such as sputter deposition) have generally been used to manufacture energetic materials, for example by the deposition of alternating layers of Al and CuO thin films within a vacuum chamber. The extent or quality of the vacuum present in such chambers is never perfect, and residual traces of certain contaminant gases are generally always present. The most significant contaminant gas is generally water vapor. Water vapor is known to adsorb readily on surfaces within vacuum chambers and to react with oxidizable metals (such as Al) to form metal oxides (such as $Al_2O_3$).

For MIC's that include at least one highly oxidizable material (e.g. Al) and a second material that is a metal oxide formed using physical vapor deposition techniques such as sputtering, there thus exists a thin interfacial region (e.g. interfacial layer) between the two reactant materials that is already reacted highly oxidizable material (e.g. oxidized), prior to any intentional initiation of a self-propagating reaction. Published work presumes or explicitly states that the interfacial reacted zone is always present, generally having a thickness of at least 2-5 nms, such as for an Al/CuO MIC. Moreover, those having ordinary skill in the art generally recognize that such interfacial layers are required to reduce provide stability to the MIC with respect to unintentional initiations.

SUMMARY

This Summary is provided to comply with 37 C.F.R. §1.73, presenting a summary of the invention to briefly indicate the nature and substance of the invention. It is submitted with the understanding that it will not be used to interpret or limit the scope or meaning of the claims.

Embodiments of the present invention describe MICs that comprise a first material and a second material that are capable of an exothermic chemical reaction with one another to form at least one product. The first and second material are in sufficiently close physical proximity to one another so that upon initiation the exothermic chemical reaction develops into a self initiating reaction. As defined herein, a MIC is a composite structure that can sustain a self-propagating reaction. At least one of the first and second materials comprise a metal (e.g. Al) that is reactive with water vapor at room temperature and the other material is a metal oxide. The interfacial region averages <2 nm thick, such as averaging <1 nm thick. As noted in the background above, for conventional MICs, the interfacial region generally averages at least 2-5 nm, and is generally recognized by those having ordinary skill in the art required to be present in at least that thickness to reduce unintentional initiations, such as due to electrostatic discharge (ESD).

Embodiments of the present invention are based on the unexpected discovery by the Inventors that the average thickness of the interfacial region over the entire interface area can be reduced to averaging <2 nm thick, typically averaging <1 nm thick, and still provide substantially the same level of stability against unintentional initiations provided by convention thicker interfacial regions (e.g. >2 to 5 nms, or more). MICs having a reduction in the thickness of the interfacial region according to embodiments of the invention have been found to perform quite differently as compared to known MICs. For example, as described below, the reaction velocity for MICs according to embodiments of the invention are generally increased by a factor of five (5) or more as compared to conventional MICs. Accordingly, MICs according to embodiments of the invention having an average thickness of the interfacial region over the entire interface area reduced to <2 nm thick evidence criticality, provide an unexpected result, and perform quite differently (e.g. significantly better reaction velocity) as compared to known MICs.

Disclosed embodiments include a method for forming a MICs including providing a vacuum level of $<10^{-8}$ torr base pressure in a deposition chamber. A first layer of a first material including a metal that is reactive with water vapor at room temperature is deposited, followed by depositing a second layer of a second material that is a metal oxide on the first layer. The first and second material are capable of an exothermic chemical reaction with one another to form at least one product, and the first and second layer are in sufficiently close physical proximity to one another so that upon initiation of the exothermic reaction the reaction develops into a self initiating chemical reaction. An interfacial region averaging <1 nm thick is formed between the first layer and second layer from a reaction of the first material with water vapor. In one embodiment, the first material is Al and the second material is CuOx.

DESCRIPTION OF THE DRAWINGS

A fuller understanding of the present invention and the features and benefits thereof will be obtained upon review of the following detailed description together with the accompanying drawing, in which.

DETAILED DESCRIPTION

Figure 1:
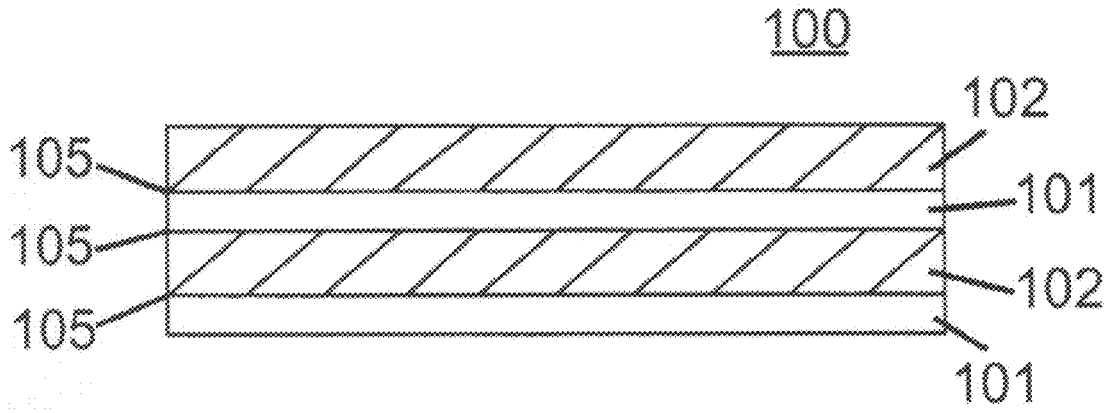
FIG. 1 is a cross section depiction of a layered MIC foil comprising alternating first material layers and second material layers, having an interfacial region therebetween, according to an embodiment of the invention.

The present invention is described with reference to the attached FIGs., wherein like reference numerals are used throughout the FIGs. to designate similar or equivalent elements. The FIGs. are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention.

The present invention is not limited by the illustrated ordering of acts or events, as some acts may occur in different orders and/or concurrently with other acts or events. Furthermore, not all illustrated acts or events are required to implement a methodology in accordance with the present invention.

As noted in the background above, conventional physical vapor deposition techniques, such as sputter deposition, results in the formation of reacted (oxidized) interface layers between the respective materials that are generally at least 2 to 5 nms thick when one of the materials is an oxidizable metal (e.g. Al) and the other material is a metal oxide. Embodiments of the invention reduce the thickness of the reacted layer interface to average <2 nm, and in typical embodiments averaging <1 nm, by performing the deposition or other processing in the near absence of water vapor. For example, vapor deposit (physical vapor deposition, i.e., sputtering) of the layers of the energetic material in a vacuum system can be performed according to embodiments of the invention with approximately $\geqq 100$ times less water vapor present as compared to conventional processes.

To achieve the $\geqq 100\times$ reduction in water vapor (essentially water vapor free atmosphere) compared to conventional MIC sputter processes, one aspect is the vacuum level in the chamber prior to deposition is typically kept in the low $10^{-8}$ torr range of vacuum vs. typical high vacuum sputtering uses chambers with vacuum levels in the $10^{-5}$ to $10^{-6}$ torr range. This difference can be accomplished by details of the design of the vacuum chamber which is generally stainless steel, the chamber seals to the outside atmosphere, and the way the equipment is operated. The net effect of this difference in vacuum level is to reduce the amount of water vapor that desorbs from the interior vacuum chamber surfaces during the deposition of the thin films. For sputter deposited thin films, the deposition generally occurs in an ambient of $10^{-3}$ to $10^{-2}$ torr of Ar (or other chemically inert gas).

Additionally, a much higher purity of Ar (or other chemically inert) gas for sputtering is used. For example, deposition of thin films is conventionally performed in "high purity" and "ultra-high purity" Ar gases having quoted purities (by the supplier) of 99.99% or 99.999%. This is generally not sufficient to provide an essentially water vapor free atmosphere during deposition. In disclosed processing, a heated metal getter purifier for the Ar gas is generally used to further purify the Ar gas immediately prior to its introduction to the vacuum chamber (point-of-use purification). This design is specified to provide at least parts per million purity from water vapor contamination, and to typically provide parts per billion purity levels.

This essentially water vapor free atmosphere has been found by the t Inventors to allow the formation of most interface regions without a generally measurable interfacial region thickness being formed, still generally being non-measurable using high resolution transmission electron microscope (HR-TEM) detection. As described below, it has been observed that when the quality of the vacuum is degraded, e.g., by use of normal purity levels of gases, interfacial regions having a thickness of about 2 to 5 nms are formed, the reaction velocity is significantly degraded, such as by a factor of five (5) or more as compared to reaction velocities provided by MICs according to embodiments of the invention.

FIG. 1 shows a cross section depiction of a layered MIC foil 100 comprising alternating first material layers 101 and second material layers 102, having an interfacial region therebetween 105, according to an embodiment of the invention. The first and the second material are in sufficiently close physical proximity to one another so that upon initiation an exothermic reaction results that develops into a self initiating reaction. At least one of the first and the second material comprise a metal that is reactive with water vapor at room temperature. The interfacial region 105 is thinner as compared to conventional interface layers which as described above generally average 3-5 nms thick, averaging <2 nm thick, and generally average <1 nm thick. Example MIC combinations include $CuO_x$/Al, $KClO_3$/Al, polytetrafluoroethylene/Al, CuO/Mg, Ti/CuO, Y/$MnO_2$, and Y/$WO_3$.

For MIC foil 100, the respective layer 101 and 102 thicknesses are generally from 5 to 200 nm thick, such as 15 to 75 nm thick. A typical bilayer period is 30 to 120 nm.

Deposition methods are also described in which water vapor is substantially excluded from interfacial zones of the reactants. In one embodiment, sputtering is used, where the deposition chamber base pressure during deposition is $<10^{-8}$ Torr, such $\leqq 6\times10^{-9}$ Torr. The sputter gas, such as Ar, can be gettered to remove substantially all moisture, for example, using a hot reactive metal gettering device. In addition, the sputter chamber is generally conditioned for several days, including a conditioning deposition to further reduce the moisture level in the deposition chamber, such as with a Ti deposition. Besides sputtering, in other embodiments of the invention, evaporation or other physical vapor deposition processes may also be used.

Although generally described as a layered MIC, the invention can be embodied in other forms, such as rods and powders. In another embodiment, one material is provided in a wire thread arrangement, with the other material filling the gaps between the threads.

In the case of a layered MIC, the respective layers may be deposited on a substrate, such as a glass slide or a silicon substrate (e.g. wafer), and then separated from the substrate. In one particular embodiment, the layered MIC is deposited on a dissolvable substrate, and is separated from the substrate by dissolving the substrate in a suitable solvent that does not dissolve either of the MIC layers.

MICs according to the invention can be used in a wide variety of applications requiring the generation of intense, controlled amounts of heat. Such structures conventionally comprise a succession of substrate-supported coatings that, upon appropriate excitation, undergo an exothermic chemical reaction that spreads across the area covered generating controlled amounts of heat. These reactive coatings can be used as sources of heat for welding, soldering or brazing, they can also be used in other applications requiring controlled local generation of heat such as propulsion and ignition.

EXAMPLES

It should be understood that the Examples described below are provided for illustrative purposes only and do not in any way define the scope of the invention.

The specific example described herein comprised an Al/copper oxide (CuO) multilayered MIC sample (comprising typically 40, 20, or 10 pairs of alternating Al and copper oxide layers) having a total thickness of approximately 3.2 microns, prepared by magnetron sputter deposition. The deposition was an automated deposition. The sputter targets comprised a CuO target and an Al target.

The processing conditions comprised a chamber base pressure $<10^{-8}$ Torr, such as $\leqq 6\times10^{-9}$ Torr, with the Ar sputter gas gettered with a hot reactive metal gettering device to remove substantially all the moisture. The sputter chamber was conditioned for several days before forming the MIC, and included a conditioning deposition with a layer of Ti prior to the deposition of the MIC on the substrate. An example of a conditioning deposition of Ti within the chamber is for a period of 15 minutes at a deposition rate sufficient to provide a 100 nm Ti deposit in that time.

Figure 2:
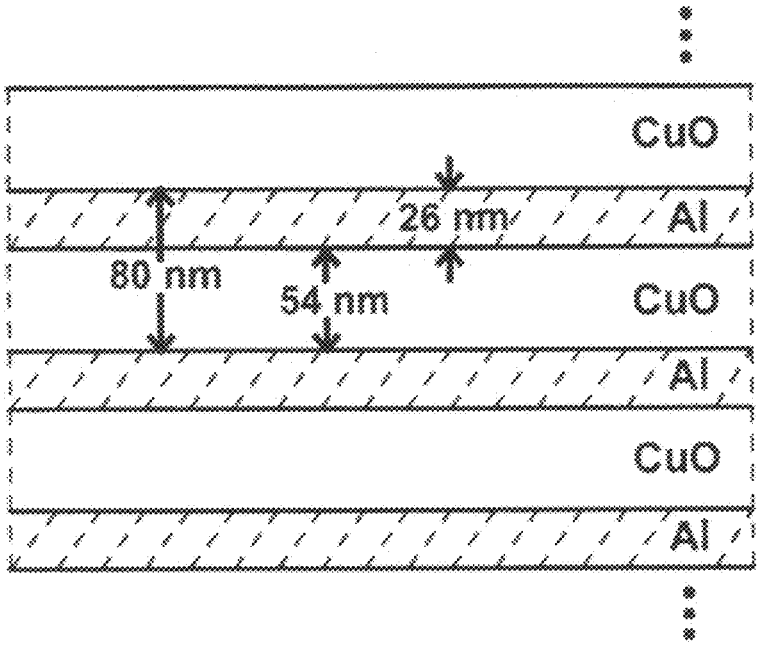
FIG. 2 is a schematic cross-sectional depiction of a layered Al/CuO MIC foil, showing exemplary dimensions, prepared by magnetron sputter deposition, according to an embodiment of the invention.

A transmission electron microscopy (TEM) image of an as-deposited MIC formed according to an embodiment of the invention was obtained. FIG. 2 provides a cross-sectional depiction of the layered Al/CuO MIC foil based on the TEM having a total thickness of 3.2 μm and 40 pairs of Al and copper oxide layers. An Al layer having a thickness of 26 nm and copper oxide layer having a thickness of 54 nm provided the bilayer period of 80 nm shown.

HRTEM images of the interfacial region between the two reactant layers were obtained for analyzing the interface regions. A small fraction (e.g. <15%) of the sample interfacial regions were found to have a width (thickness) consistent with conventional interfacial reacted zones, being 2 to 5 nm. However, for the majority (>80%) of reactant interfaces examined, the interfacial reacted zones were found to be undetectable. The detection limit for the HRTEM used was estimated at 0.25 nm. Thus, the data obtained evidences preparation of a MIC with interface regions averaging <1 nm thick, and in most samples the interfacial reacted zones being to thin to detect, and thus considered to be substantially absent.

Figure 3:
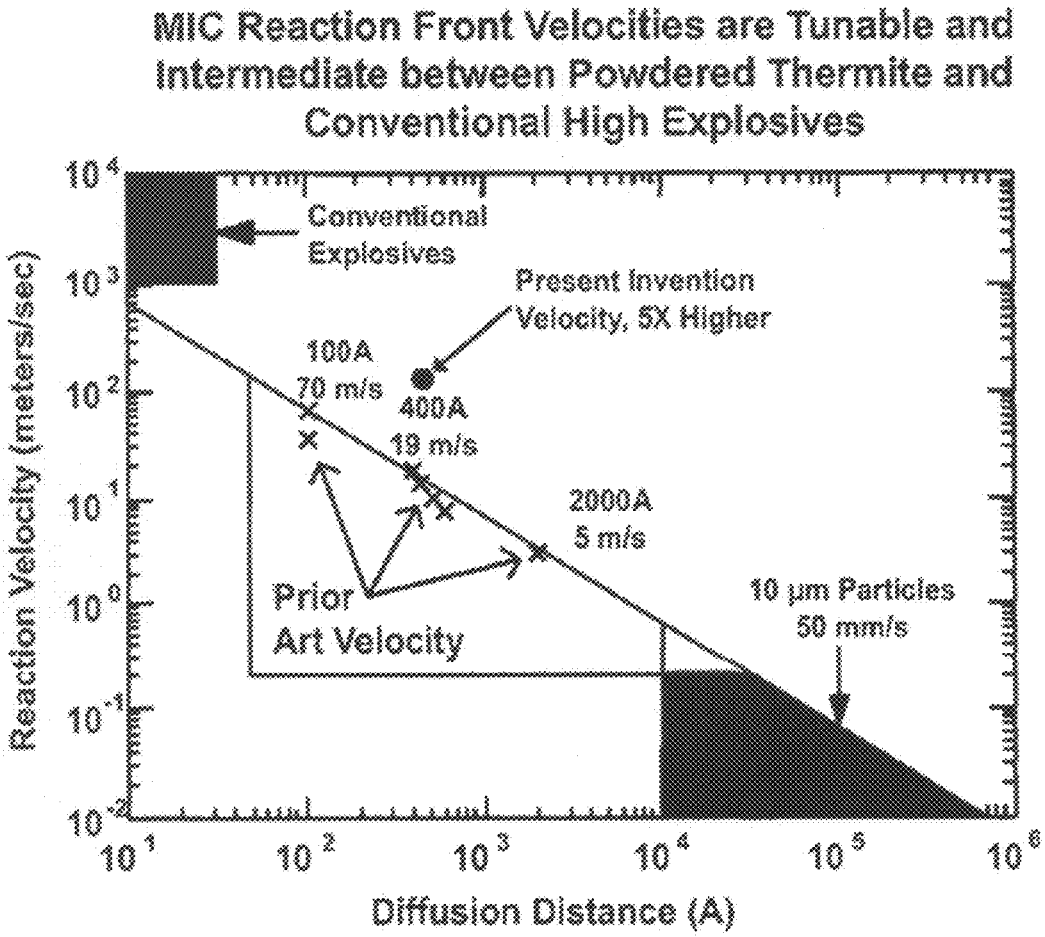
FIG. 3 compares reaction velocity results obtained for MICs formed from Al/copper oxide reactants and processes according to an embodiment of the invention with published data from conventional Al/copper oxide reactants and conventional processes for a range of layer thicknesses.

For the Al/copper oxide MICs, reaction velocities for a fully dense MIC freestanding film obtained by the Inventors were generally found to be at least 50 m/sec and be as high as 150 m/sec. Reaction velocity is known to be a function of the reactant materials chosen and of the layer thicknesses of the reactants. FIG. 3 compares reaction velocity results obtained for Al/copper oxide reactants with published data from others for Al/copper oxide reactants and a range of layer thicknesses expressed as a diffusion distance, which is equal to one half of the bilayer period defined above. The reaction velocity for the Al/copper oxide composite according to an embodiment of the invention can be seen to be more than a factor of five (5) higher as compared to a conventional MIC having the same materials and the same layer thicknesses.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and/or the claims, such terms are intended to be inclusive in a manner similar to the term "comprising."

What is claimed:

1. A method of forming a metastable intermolecular composite (MIC), comprising:

providing a pressure level of $<10^{-8}$ torr base pressure in a deposition chamber;

depositing a first layer of a first material comprising a metal that is reactive with water vapor at room temperature, and depositing a second layer of a second material comprising a metal oxide on said first layer, said first and said second material being capable of an exothermic chemical reaction with one another to form at least one product, said first and said second layer in sufficiently close physical proximity to one another so that upon initiation of said exothermic chemical reaction develops into a self initiating chemical reaction, wherein an interfacial region averaging <1 nm thick is formed between said first layer and said second layer from a reaction of said first material with water vapor.

2. The method of claim 1, wherein said depositing said first layer and said depositing said second layer both comprise sputtering with a sputter gas.

3. The method of claim 2, further comprising the step of gettering said sputter gas before reaching said deposition chamber to reduce moisture entering said deposition chamber.

4. The method of claim 3, wherein said step of gettering comprises using a heated metal getter purifier.

5. The method of claim 1, wherein said first layer and said second layer are both from 15 nm to 75 nm thick.

6. The method of claim 1, wherein said first layer and said second layer comprise at least one of $CuO_x$/Al, $KClO_3$/Al, CuO/Mg, Ti/CuO, Y/$MnO_2$, and Y/$WO_3$.

7. The method of claim 1, wherein said first layer and said second layer comprises Al/CuOx.

8. The method of claim 1, wherein said MIC comprises a fully dense MIC, wherein a reaction velocity of said fully dense MIC is ≧50 m/sec.

9. The method of claim 1, wherein said depositing said first layer and said depositing said second layer are repeated alternately to form a layered MIC including layers of said first material alternating with layers of said second material stacked on one another with said interfacial region therebetween.

10. A method of forming a metastable intermolecular composite (MIC), comprising:

providing a pressure level of $<10^{-8}$ torr base pressure in a deposition chamber;

sputter depositing a first layer of a first material comprising a metal that is reactive with water vapor at room temperature, and sputter depositing a second layer of a second material comprising a metal oxide on said first layer, said first and said second material being capable of an exothermic chemical reaction with one another to form at least one product, said first and said second layer in sufficiently close physical proximity to one another so that upon initiation of said exothermic chemical reaction develops into a self initiating chemical reaction, wherein a sputter gas used for said sputter depositings is gettered to reduce water vapor using a heated metal getter purifier before reaching said deposition chamber, and wherein an interfacial region averaging <1 nm thick is formed between said first layer and said second layer from a reaction of said first material with water vapor.

* * * * *